US007052013B2

(12) United States Patent
Olsen

(10) Patent No.: US 7,052,013 B2
(45) Date of Patent: May 30, 2006

(54) STACKING GAME AND METHOD

(76) Inventor: Jon Sinclair Olsen, 1603-1401 Prince of Wales Drive, Ottawa, Ontario (CA) K2C 3J8

( * ) Notice: Subject to any disclaimer, the term of this patent is extended or adjusted under 35 U.S.C. 154(b) by 68 days.

(21) Appl. No.: 10/697,492

(22) Filed: Oct. 31, 2003

(65) Prior Publication Data

US 2005/0093244 A1 May 5, 2005

(51) Int. Cl.
*A63F 9/26* (2006.01)

(52) U.S. Cl. ..... 273/450; 273/459

(58) Field of Classification Search ..... 273/440, 273/447, 449, 450, 459, 309, 281, 282.3, 273/287, 288, 290
See application file for complete search history.

(56) References Cited

U.S. PATENT DOCUMENTS 3,768,176 A * 10/1973 Huddleston ..... 434/237
3,785,647 A * 1/1974 Bender ..... 273/450
3,839,820 A * 10/1974 Serman, Jr. ..... 446/309
4,696,477 A * 9/1987 Tsuzuki ..... 273/241
4,932,655 A 6/1990 Kurita
4,938,472 A 7/1990 Gould et al.
5,007,636 A 4/1991 Pagani
5,067,729 A 11/1991 Hunter et al.
5,072,936 A 12/1991 Warehime
5,240,260 A * 8/1993 Strongin ..... 273/445
5,265,884 A 11/1993 Stein
5,480,159 A 1/1996 Alsip
5,611,544 A 3/1997 Grebler et al.
5,954,340 A 9/1999 Tedesco
6,022,026 A 2/2000 Johnson, III
6,149,494 A * 11/2000 Yang ..... 446/441
6,161,832 A 12/2000 Holahan et al.
6,398,222 B1 * 6/2002 Everett ..... 273/287
6,502,819 B1 * 1/2003 Rieber et al. ..... 273/126 R

* cited by examiner

*Primary Examiner*—Raleigh W. Chiu
(74) *Attorney, Agent, or Firm*—Hoffman, Wasson & Gitler PC

(57) ABSTRACT

A game device that includes non-uniformly shaped playing pieces that may be stacked onto an arrangement of multiple, base structures, the base structures having one or more substantially planar playing surfaces thereon, the playing pieces suitable for stacking on the playing surfaces in an unrestricted manner in accordance with rules for playing the game. The game may include a game board to which the base structures are securable.

15 Claims, 8 Drawing Sheets

STACKING GAME AND METHOD

FIELD OF THE INVENTION

The present invention relates generally to game devices and more particularly to a game device and method which requires players to stack non-uniformly shaped playing pieces onto an arrangement of multi-levelled base structures in an unrestricted manner.

BACKGROUND OF THE INVENTION

Other games exist which require participants to stack playing pieces onto a base structure. U.S. Pat. No. 5,480,159, issued to Alsip on Jan. 2, 1996, describes a game of skill, which includes a single base element having a horizontal upper playing surface and a plurality of uniformly thick playing pieces. The playing pieces are stacked on the playing surface until an upper limit is reached. Players then continue to place playing pieces on the stack until the structure is toppled.

U.S. Pat. No. 4,932,655, issued to Kurita on Jun. 12, 1990, describes a single elastic support structure on which weighted disc-shaped playing pieces are stacked.

U.S. Pat. No. 5,007,636, issued to Pagani on Apr. 16, 1991, describes a game apparatus for supporting a variety of games, including an unstable beam upon which playing pieces are stacked. The playing pieces are described as figures having a flat base and a flat upper surface.

U.S. Pat. No. 5,072,936, issued to Warehime on Dec. 17, 1991, describes a game which requires players to stack small magnetic marbles onto a single elevated base structure.

Considering the above-noted prior art, it would be advantageous to develop a game that requires players to stack non-uniformly shaped playing pieces onto an arrangement of multi-levelled base structures in an unrestricted manner, which can be played using many different game playing rules and strategies, and which is easy to understand and play by people of all ages.

BRIEF SUMMARY OF THE INVENTION

It is an object of one aspect of the present invention to provide a game of skill and strategy and a method of play, which can be understood and played equally well by participants of all ages.

It is an object of another aspect of the present invention to provide a multi-dimensional game of skill and strategy.

It is an object of another aspect of the present invention to provide a game requiring players to stack non-uniformly shaped playing pieces onto an arrangement of multi-levelled base structures in an unrestricted manner.

It is an object of a further aspect of the present invention to provide a game of skill that can be played by two or more players.

It is an object of another aspect of the present invention to provide a game that includes a game board that can be either free standing or placed on a table top for support.

According to one aspect of the present invention, there is provided a game comprising: multiple base structures, each of said base structures having at least one substantially planar playing surface thereon, at least one of said playing surfaces being non-horizontal; and multiple non-uniformly shaped playing pieces suitable for stacking on said playing surfaces in an unrestricted manner in accordance with rules for playing the game, said playing pieces varying in size according to a predetermined number of preselected sizes, said playing pieces being coloured, said playing pieces having the same said preselected size being the same colour, said differently sized playing pieces being differently coloured, the number of said base structures being equal to said predetermined number of said preselected sizes of said playing pieces, each of said base structures having a preselected colour, and each said preselected colour of said base structures corresponding to the colour of a selected one of said playing pieces.

According to another aspect of the present invention, there is provided a game comprising: a game board; multiple base structures removably securable to said game board, each of said base structures having one or more substantially planar playing surface thereon, selected ones of said playing surfaces being non-horizontal, said playing surfaces being non-uniform in shape and surface area; and multiple non-uniformly shaped playing pieces suitable for stacking on said playing surfaces in an unrestricted manner in accordance with rules for playing the game, said playing pieces varying in size according to a predetermined number of preselected sizes, said playing pieces being coloured, said playing pieces having the same said preselected size being the same colour, said differently sized playing pieces being differently coloured, the number of said base structures being equal to said predetermined number of said preselected sizes of said playing pieces, each of said base structures having a preselected colour, and each said preselected colour of said base structures corresponding to the colour of a selected one of said playing pieces.

According to yet another aspect, there is provided a game comprising: multiple base structures, each of said base structures having at least one substantially planar playing surface thereon; and multiple non-uniformly shaped playing pieces suitable for stacking on said playing surfaces in an unrestricted manner in accordance with rules for playing the game, said playing pieces varying in size according to a predetermined number of preselected sizes, wherein the number of said base structures is equal to said predetermined number of said preselected sizes of said playing pieces, said playing pieces being coloured, said playing pieces having the same said preselected size being the same colour, said differently sized playing pieces being differently coloured, each of said base structures having a preselected colour, and each said preselected colour of said base structures corresponding to the colour of a selected one of said playing pieces.

According to a further aspect of the present invention, there is also provided a method of game play comprising: assembling multiple base structures on a surface, each of said base structures having at least one substantially planar playing surface thereon, at least one of said playing surfaces being non-horizontal; providing multiple non-uniformly shaped playing pieces suitable for stacking on said playing surfaces in an unrestricted manner, said playing pieces varying in size according to a predetermined number of preselected sizes, said playing pieces being coloured, said playing pieces having the same said preselected size being the same colour, said differently sized playing pieces being differently coloured, the number of said base structures being equal to said predetermined number of said preselected sizes of said playing pieces, each of said base structures having a preselected colour, and each said preselected colour of said base structures corresponding to the colour of a selected one of said playing pieces; selecting one of said playing pieces and one of said base structures; and placing said selected playing piece on one of said playing surfaces on said selected base structure.

According to another aspect, there is provided a further method of game play comprising: assembling multiple base structures on a surface, each of said base structures having at least one substantially planar playing surface thereon; providing multiple non-uniformly shaped playing pieces suitable for stacking on said playing surfaces in an unrestricted manner, said playing pieces varying in size according to a predetermined number of preselected sizes; selecting one of said playing pieces and one of said base structures; and placing said selected playing piece on one of said playing surfaces on said selected base structure, wherein the number of said base structures is equal to said predetermined number of said preselected sizes of said playing pieces, said playing pieces being coloured, said playing pieces having the same said preselected size being the same colour, said differently sized playing pieces being differently coloured, each of said base structures having a preselected colour, and each said preselected colour of said base structures corresponding to the colour of a selected one of said playing pieces.

One advantage of the game of the present invention is that it can be easily understood and played equally well by participants of all ages. A further advantage is that the game can be played by two or more players. Yet another advantage is that the game permits players to stack non-uniformly shaped playing pieces onto an arrangement of multi-levelled base structures in an unrestricted manner. Another advantage is that the game requires skill and strategy and therefore provides sufficient challenge and variety to maintain the interest of players and generate a competitiveness between them. A further advantage is that the game is aesthetically pleasing to the eye and may be modified to take on multiple appearances as desired.

Further objects and advantages of the present invention will be apparent from the following description, wherein various embodiments of the invention are clearly described and shown.

BRIEF DESCRIPTION OF THE DRAWINGS

In drawings that illustrate the present invention by way of example.

Corresponding reference numerals indicate corresponding parts throughout the various figures.

DETAILED DESCRIPTION OF THE INVENTION

Figure 1:
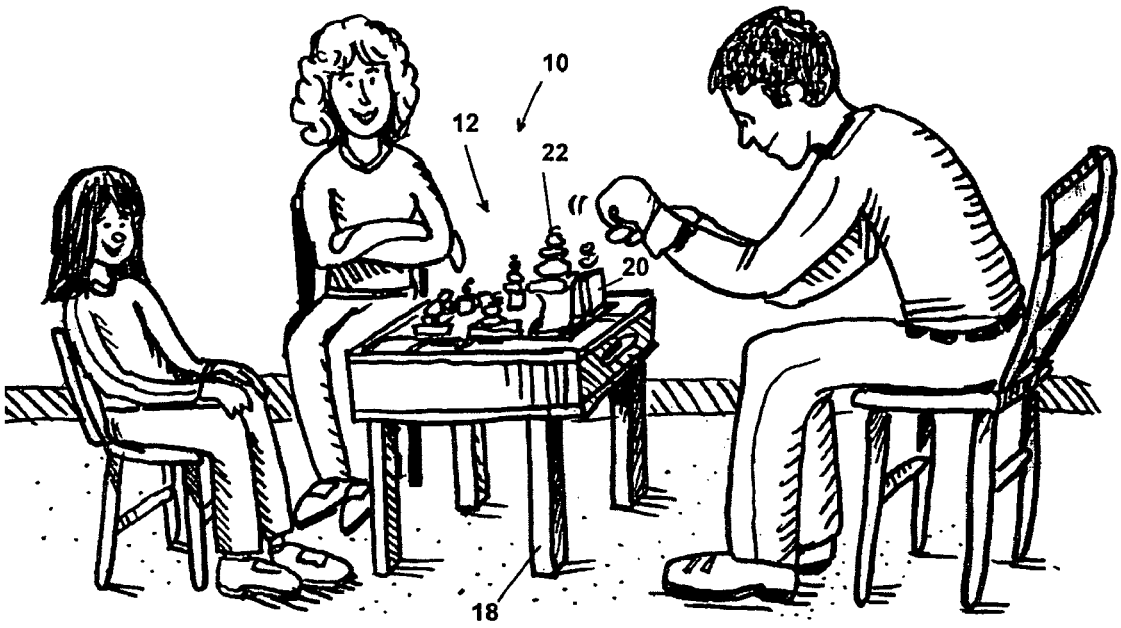
FIG. 1 is a perspective view of one embodiment of the present invention being played by several participants.

Referring to FIG. 1, game device 10 of the present invention includes a game board 12, base structures 20 and playing pieces 22.

Figure 2:
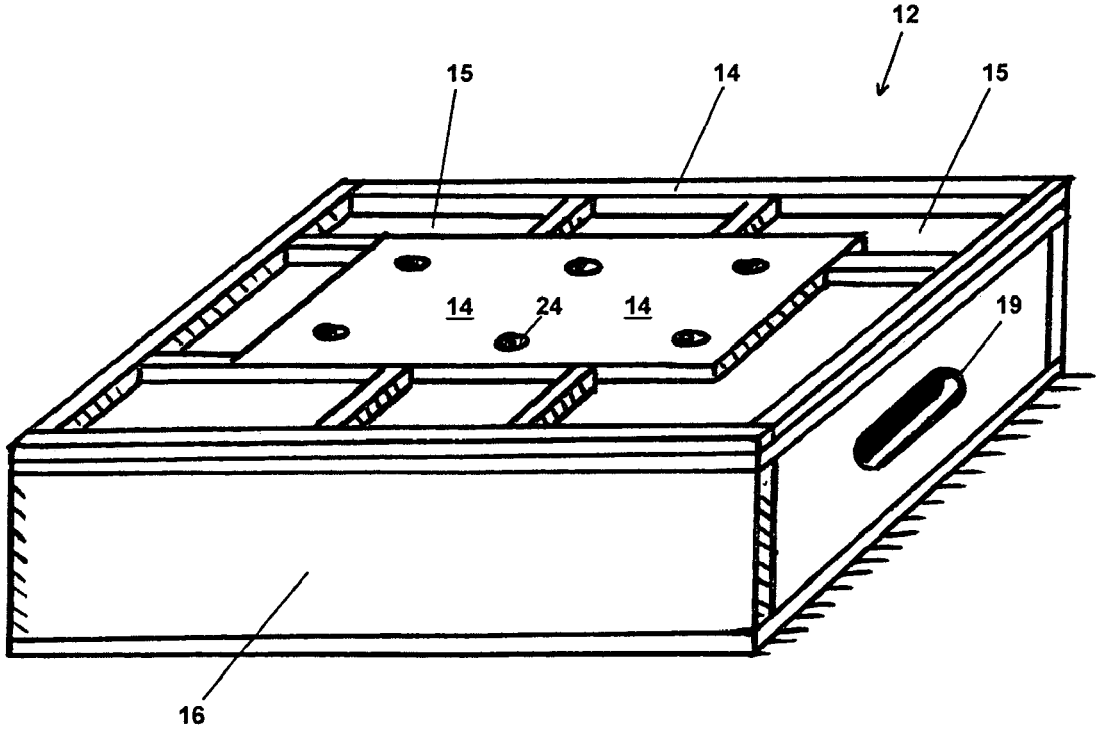
FIG. 2 is a perspective view of one embodiment of a game board for the present invention.
Figure 8:
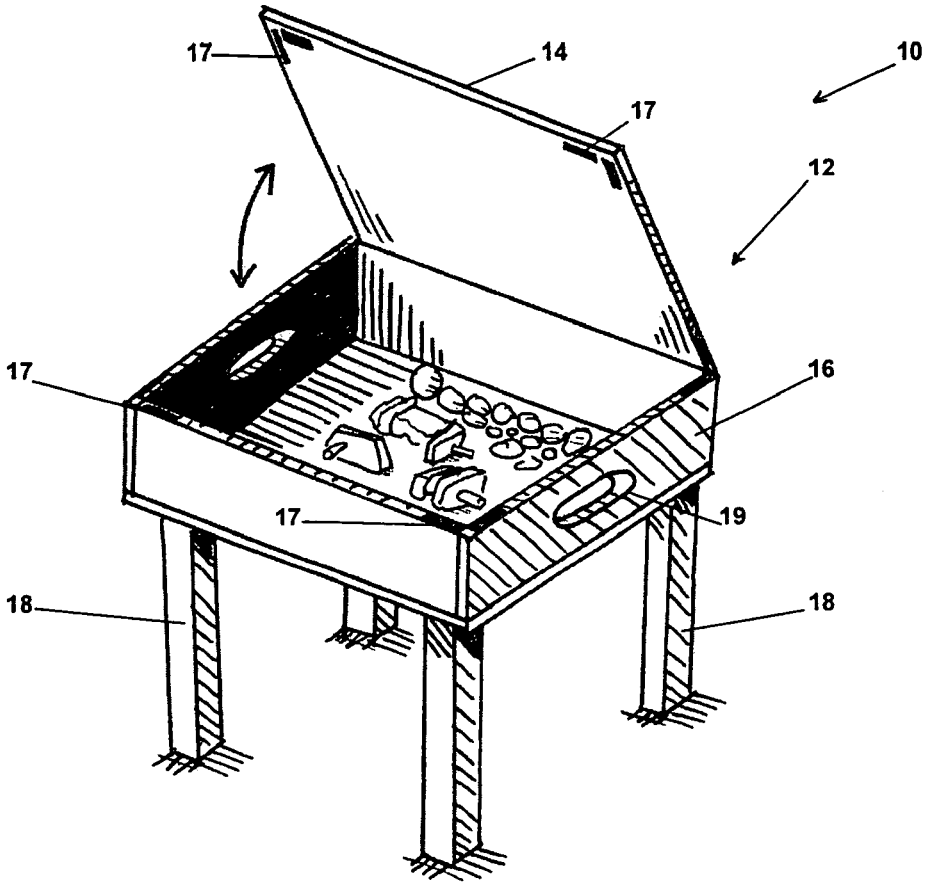
FIG. 8 is a perspective view of the game board of FIG. 5, showing a storage compartment located below the upper surface of the game board.
Figure 9:
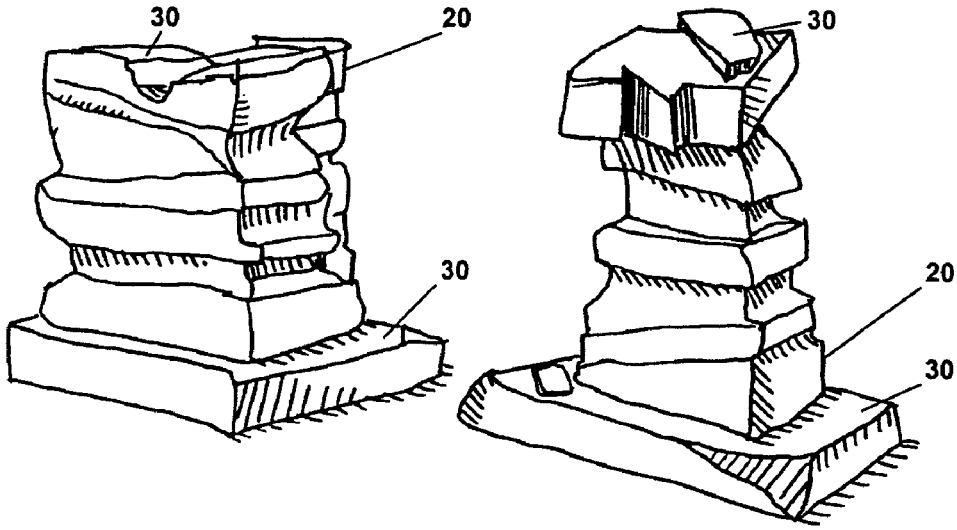
FIGS. 9, 10 and 11 are perspective views of some examples of base structures for use in the present invention.
Figure 10:
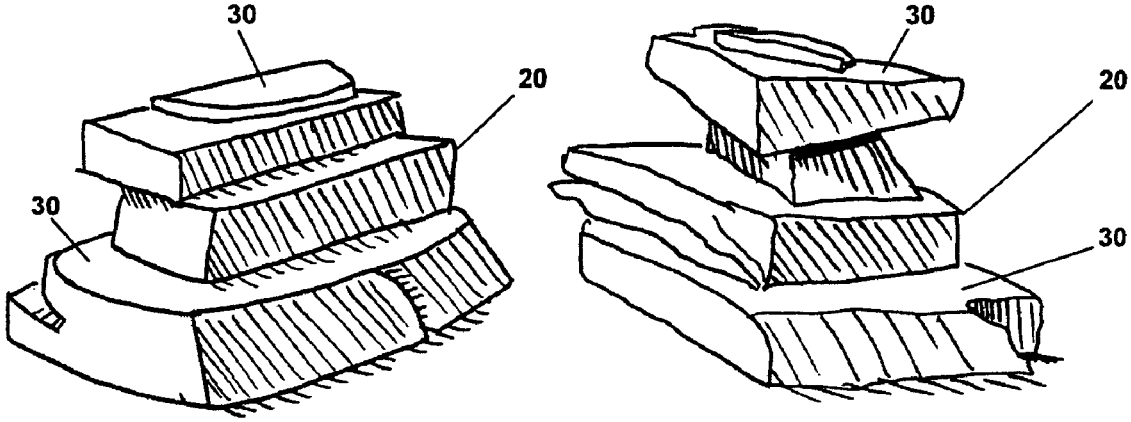
Figure 11:
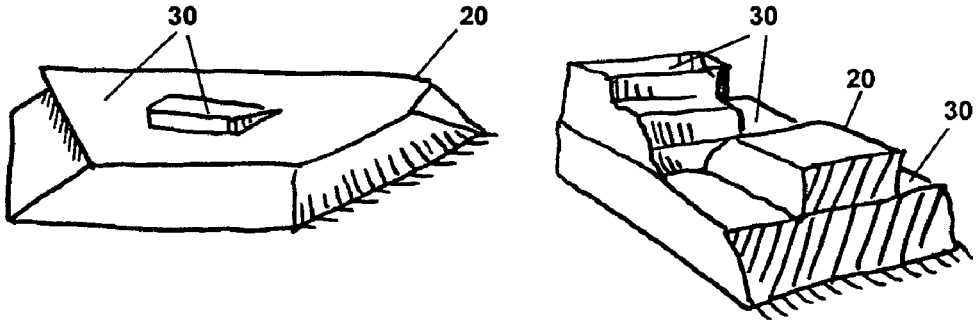
Figure 13:
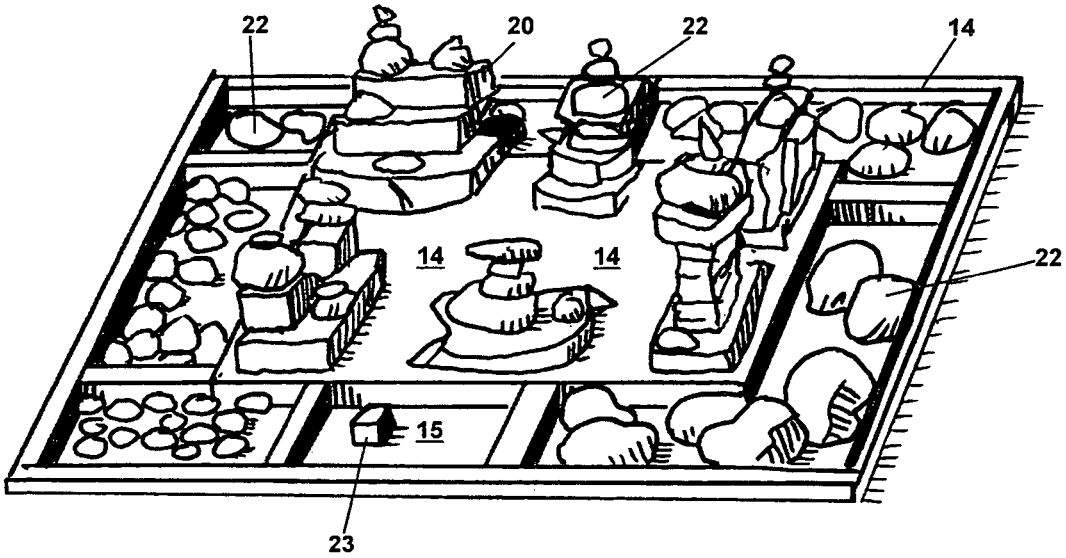
FIG. 13 is a perspective view of the upper surface of the game board shown in FIG. 2 separated from the storage compartment and resting on a table top or floor.
Figure 14:
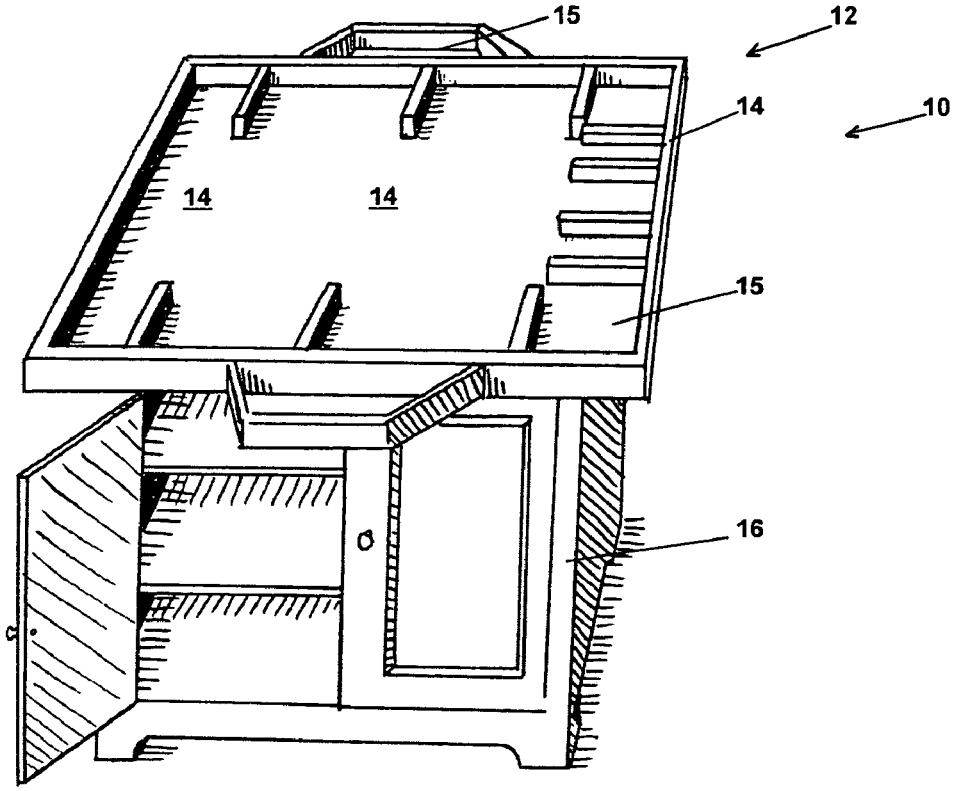
FIG. 14 is a perspective view of another embodiment of the present invention showing a modified upper surface and storage compartment for the game board.
Figure 15:
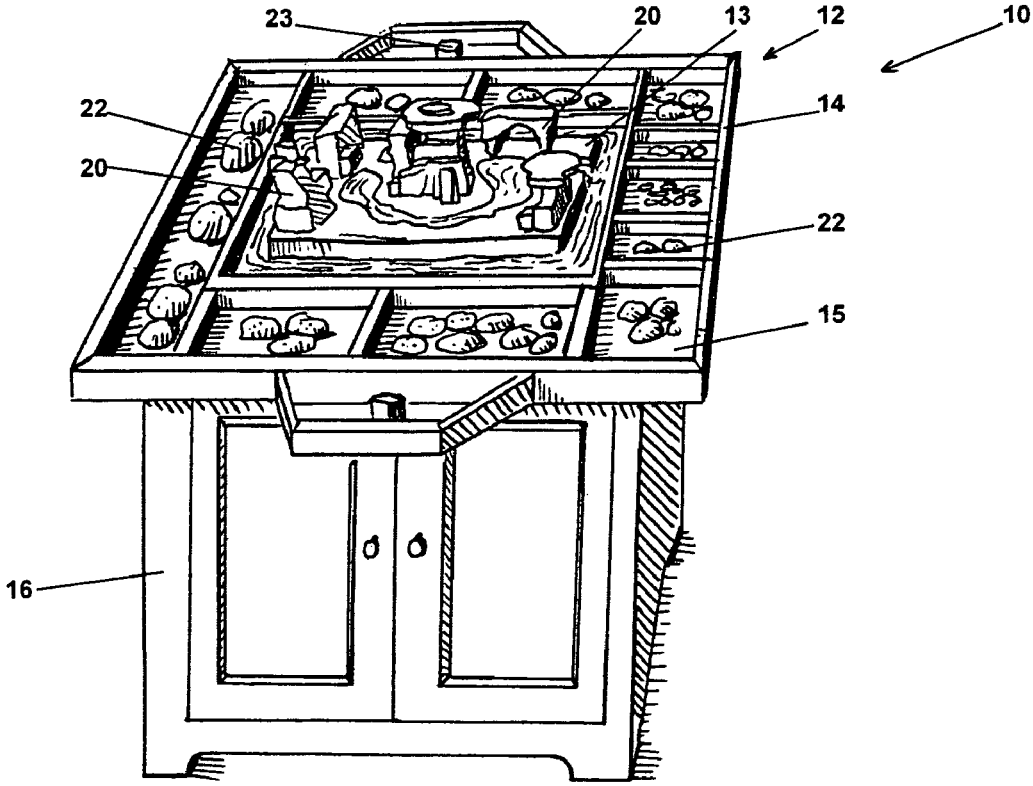
FIG. 15 is a perspective view of the modified game board shown in FIG. 14, including a game board insert.

Referring to FIGS. 2 to 8, game board 12 has an upper playing surface 14 on which base structures 20 may be secured. Upper surface 14 may include compartments 15 for holding playing pieces 22 (see FIGS. 2 and 3) and rolling standard gaming die 23. As shown in FIG. 2, board 12 may be placed on a floor or a table top during play, however, in one embodiment of the present invention shown in FIGS. 1, 5, 6, 7, and 8, game board 12 has been fitted with support legs 18. Support legs 18, may be rigidly fixed or removably attached (see FIG. 7) to the underside of game board 12. As shown in FIG. 1, support legs 18, are suitable for supporting game board 12 in a comfortable game playing position. Game board 12 may also include a storage compartment 16 located below upper surface 14 for storage of various items, including playing pieces 22, base structures 20, and support legs 18. As shown in FIGS. 8, 14 and 15, storage compartment 16 may be of any suitable configuration. Upper playing surface 14 may be secured to the top of storage compartment 16 using VELCRO™ strips 17 as shown in FIG. 8, or any other suitable means that will permit easy access, such as hinges or the like. As shown in FIGS. 14 and 15, access to storage compartment 16 may be attained through side access doors and upper surface 14 may be fixed to the top of storage compartment 16. As shown in FIG. 13, upper surface 14 may be separated completely from storage compartment 16 and placed on a floor or table top during play. Game board 12 may advantageously include carrying handles 19 to facilitate easy transport.

Figure 4:
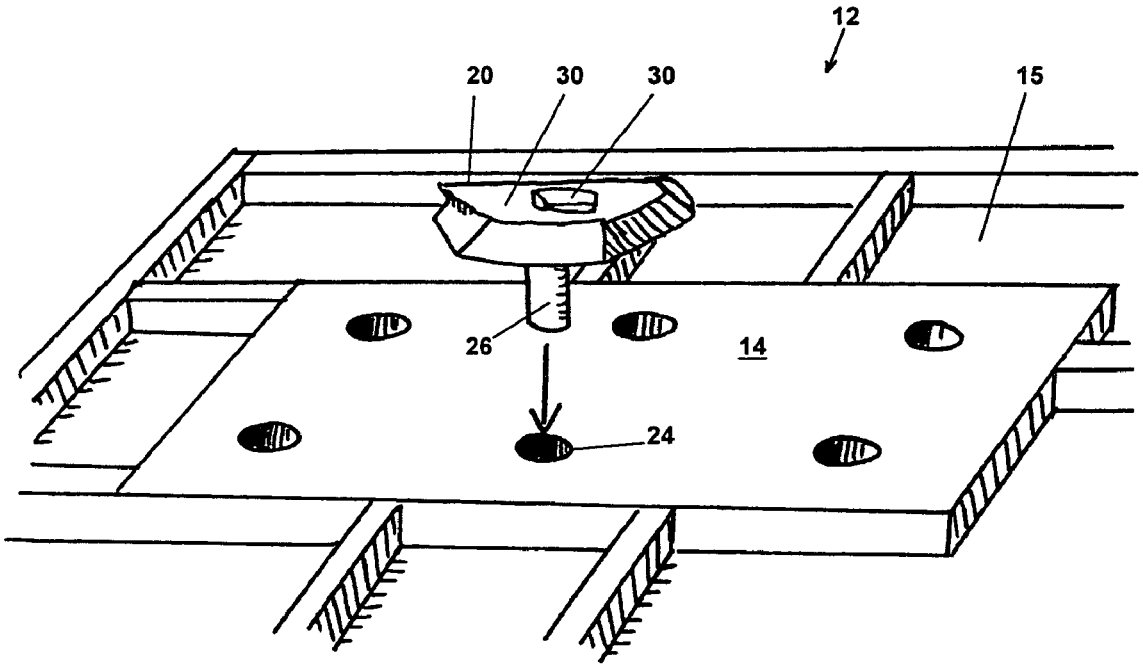
FIG. 4 is a perspective view of the game board of FIG. 2, showing one method for securing the base structures.
Figure 5:
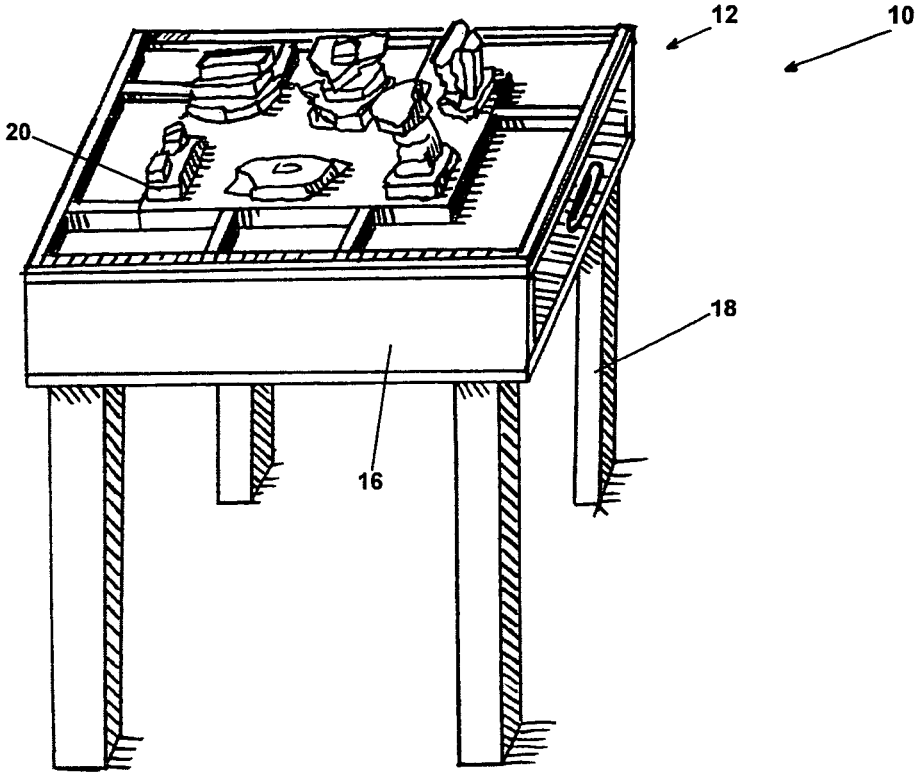
FIG. 5 is a topside perspective view of the game board of FIG. 2, showing the base structures and support legs affixed thereto.
Figure 6:
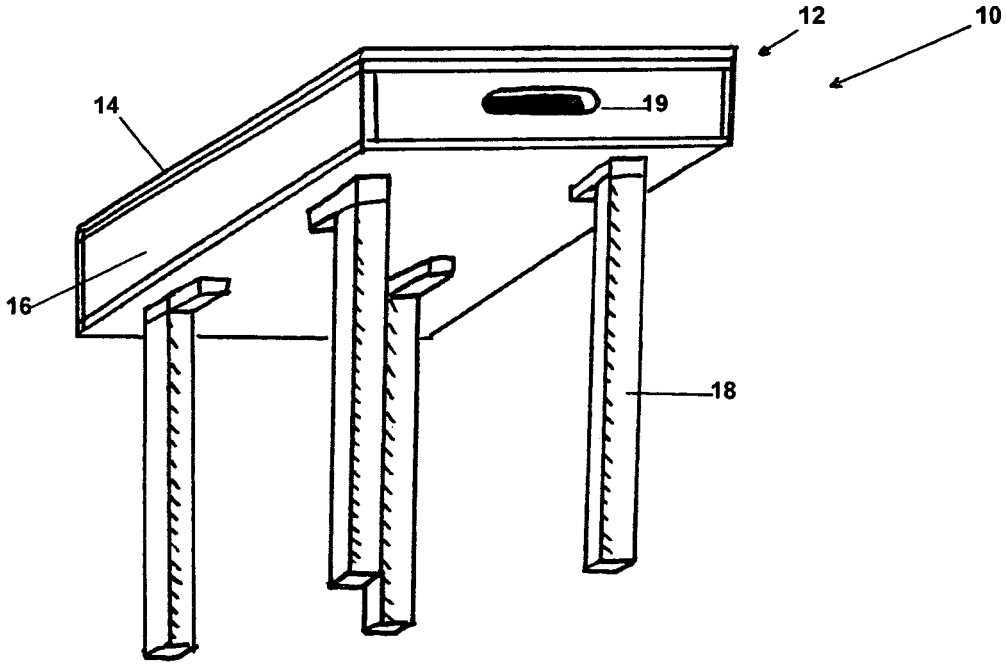
FIG. 6 is an underside perspective view of the game board of FIG. 5, showing attachment of the legs.
Figure 7:
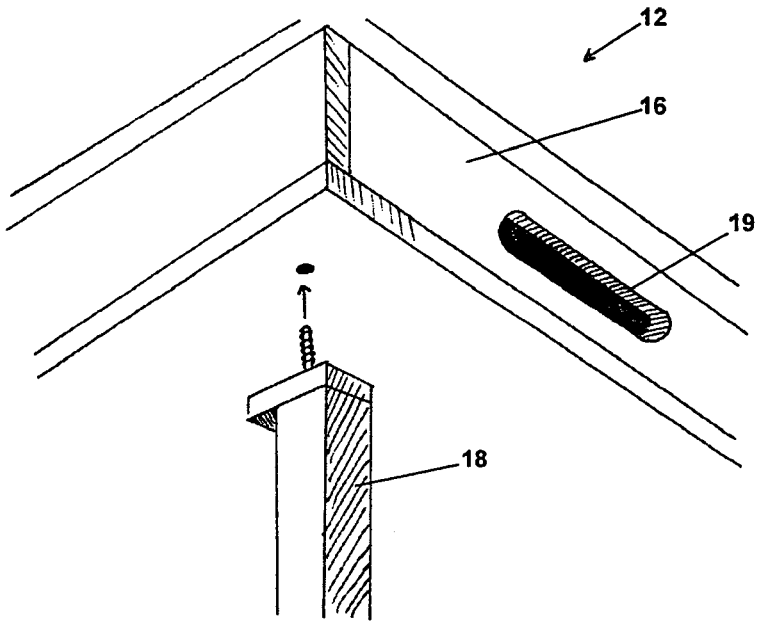
FIG. 7 is an underside perspective view of the game board of FIG. 6, showing a detailed view of the attachment of one of the legs.

Referring to FIG. 4, upper surface 14 includes a series of holes 24 corresponding to pegs 26 located on the underside of base structures 20. By inserting pegs 26 into holes 24, base structures 20 can be removably secured to game board 12. Other suitable attachment means for removably securing base structures 12 will be apparent to those skilled in the art, such as by using VELCRO™ or magnetic means, all of which are considered equivalent to the attachment means disclosed herein and therefore included within the scope of the present invention.

Although game board 12 is not an essential element of the present invention, the applicant has found that use of game board 12 enhances the enjoyment of the players and facilitates play. If game board 12 is not used, base structures 20 can be placed on or secured to any substantially flat surface such as a floor or table top. For example, the game of the present invention may be assembled and played outside on a grass lawn. In that event, pegs 26 may be sharpened for easy insertion into the lawn surface to support base structures 20 during play.

Figure 16:
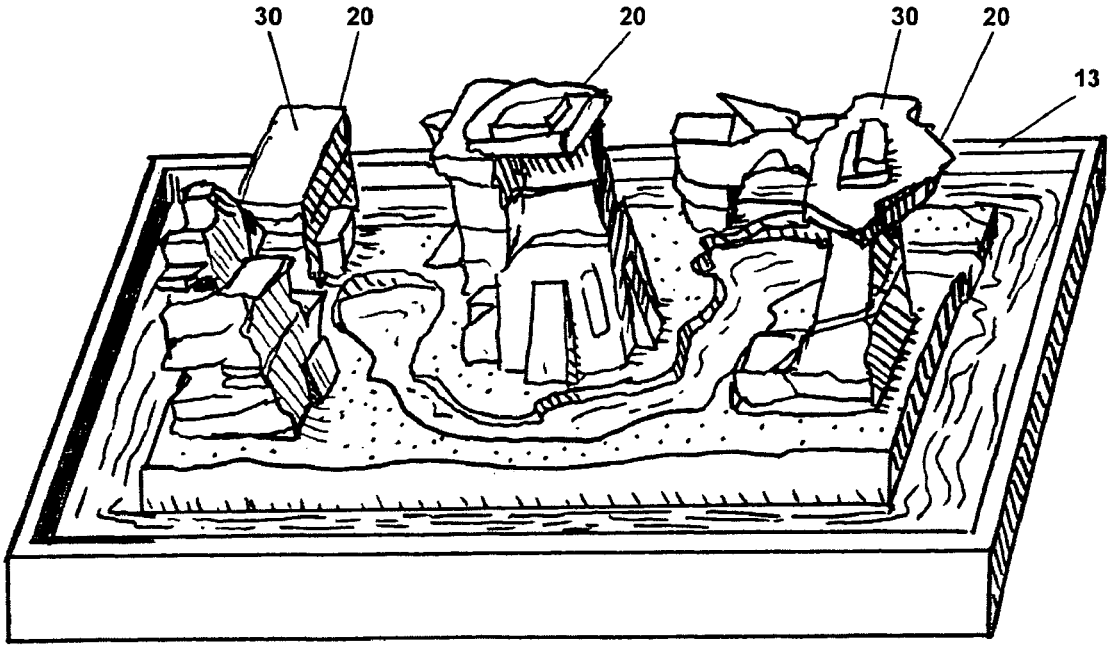
FIGS. 16 and 17 are perspective views of two examples of game board inserts for use with the game board shown in FIGS. 14 and 15.
Figure 17:
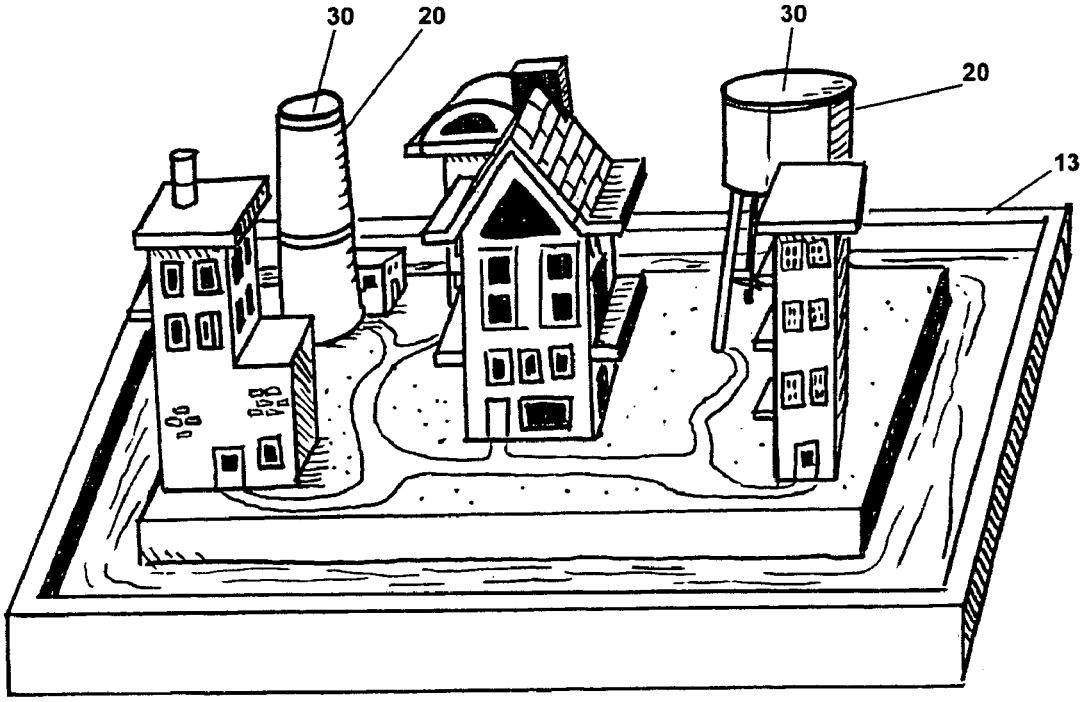

Referring to FIGS. 3, 4, 9 to 11, 16 and 17, base structures 20 include one or more playing surfaces 30 located thereon. Playing surfaces 30 are substantially planar, and are thus suitable for stacking playing pieces 22 thereon in an unrestricted manner. To increase the difficulty of stacking playing pieces 22 on playing surfaces 30, some of playing surfaces 30 may be non-horizontal when referenced to upper surface 14. To further increase difficulty and influence game playing strategy, the shape and/or surface area of playing surfaces 30 may be varied. To identify and distinguish multiple base structures 20 in the same game, base structures 20 may be constructed in different sizes, have varying numbers of playing surfaces 30, and/or be differently coloured or numbered. As shown in FIG. 17, base structures 20 may be constructed to resemble more recognizable everyday objects, thus giving the game an aesthetically pleasing appearance. Base structures 20 can be constructed of any suitable material such as wood, plastic, metal or the like.

Figure 3:
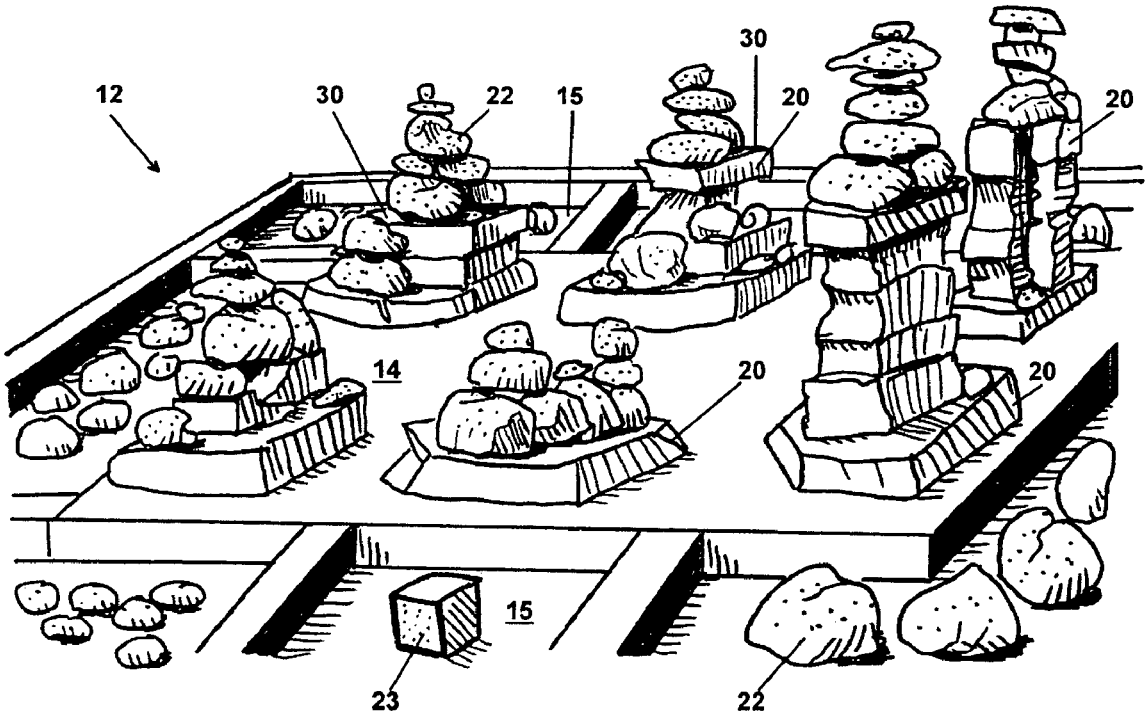
FIG. 3 is a perspective view of the game board of FIG. 2 showing base structures attached to the game board and playing pieces stacked thereon.
Figure 12:
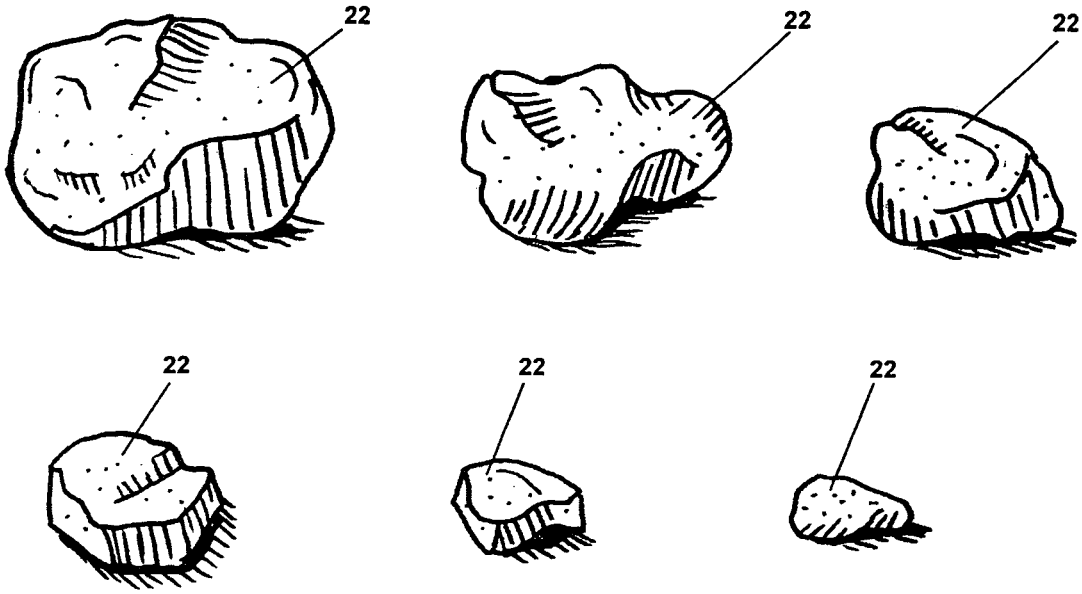
FIG. 12 is a perspective view of some examples of various sizes and shapes of playing pieces for use in the present invention.

FIGS. 3, 12 and 13 show several examples of the types of playing pieces 22 that can be used in the present invention. As shown, playing pieces 22 are generally non-uniform in shape and/or size and may also be irregularly shaped. The non-uniform and/or irregular nature of playing pieces 22 makes them suitable for stacking on playing surfaces 30 in an unrestricted manner and at the same time makes such stacking a greater challenge than if the playing pieces were regular and uniform in shape and/or size. The playing pieces shown all have the appearance of naturally occurring stones, but may be formed into more geometric solids such as cubes, tetrahedrons and the like, provided that not all playing pieces 22 are of the same uniform shape and/or size.

The number of playing pieces 22 in the game is not limited, but there should be sufficient playing pieces 22 provided so that all playing surfaces 30 can be covered and fully stacked with playing pieces 22. In one embodiment of the present invention, playing pieces 22 are provided only in a selected number of general sizes. To make it easy to identify playing pieces 22 they may be coloured or numbered according to size such that all playing pieces 22 having the same general size are also of the same colour or number. For example, in one embodiment, the applicant has found it advantageous to have playing pieces 22 that range in relative size from 1 to 6, with 6 being the largest and 1 being the smallest. Playing pieces 22 may then be coloured according to the following correspondence chart, or any other suitable correspondence between colour and size:

size 6==>purple
size 5==>blue
size 4==>green
size 3==>red
size 2==>pink
size 1==>yellow Although any number of general sizes can be used for playing pieces 22, the applicant has found that six different sizes is advantageous since the number six corresponds to the number of sides on a standard game die, which can be used by participants in the game to select which playing piece 22 must be used to stack on playing surfaces 30 and to select the base structure 20 on which playing piece 22 must be stacked. Playing pieces 22 can be constructed of any suitable material, including plastic, metal, wood, concrete, stone or the like.

In one embodiment of the invention, the number of base structures 20 used in the game corresponds to the number of different sizes of playing pieces 22. In this case, base structures 20 may be coloured or numbered to correspond to a particular colour or number (size) of playing piece 22. A game device constructed in accordance with the example presented above, might include six base structures 20, which may be numbered 1 to 6, and/or coloured yellow, pink, red, green, blue and purple, respectively.

FIGS. 14 and 15 show another embodiment of the game board 12 of the present invention. In this version, upper surface 14 of game board 12 includes a space sufficient to accommodate a game insert 13. As shown in FIGS. 15, 16 and 17, game inserts 13 include base structures 20 attached thereto and other design features associated therewith, such as roads and rivers or the like, designed to create an aesthetically pleasing environment, associated with a desired game theme. Base structures 20 may be rigidly fixed or removably attached to game insert 13 in a similar manner as earlier described for attachment of base structures 20 to upper surface 14. The purpose of using game insert 13 is to provide a quick means by which the design theme of the game of the present invention can be changed, without changing all of the game components. For example, the design can be changed from a pre-historic theme, as shown in FIG. 16, to an modern urban theme, as shown in FIG. 17, simply by exchanging game inserts 13 on upper surface 14.

As discussed earlier, FIGS. 14 and 15 show an alternate version of storage compartment 16, which may be located below upper surface 14 and which is accessible through side doors rather than from the top as earlier illustrated.

Various methods of play using game device 10 will now be described, however, it will be understood by those skilled in the art that other methods of play using game device 10 are possible depending on player preference. In general, game device 10 is designed to be played by between 2 and 12 players, but no limit is placed on the minimum or maximum number of players that may participate.

In a first example, the object of the game is to stack playing pieces 22 of six differently numbered sizes on playing surfaces 30 located on six differently numbered base structures 20, and to avoid being eliminated. A player commences his or her turn by rolling a standard six-sided gaming die 23 twice. As an alternative to using a standard gaming die, base structures 20 and playing pieces 22 may be coloured according to size, and a die having coloured sides may be used. The colours on the sides of the die corresponding to the colours of base structures 20 and playing pieces 22.

The first player to commence play may be selected in any suitable manner, such as by the roll of die 23. On the first roll, the player going first choses either one base structure 20 or one size of playing piece 22 corresponding to the uppermost number or colour on die 23. If a playing piece 22 is chosen on the first roll, a base structure 20 must be chosen on the second roll, and vice versa. On the first roll, if the corresponding size of playing piece 22 has been used up, the result of the first roll will correspond to a base structure 20. On the second roll of die 23, if the corresponding size of playing piece 22 has been used up, the player must roll die 23 again until a result corresponding to a playing piece 22 that has not been used up is obtained. The player then places the selected playing piece 20 on any playing surface 30 of the selected base structure 22. If a player rolls the same result on both rolls of die 23, the player misses a turn (this is a good thing). The player may touch only his or her selected playing piece 22 when attempting to place it on playing surface 30. A player is eliminated when he or she causes one or more playing pieces 22 to fall from any playing surface 30 when attempting to place the selected playing piece 22 on any playing surface 30 or when rolling die 23. If any playing piece 22 falls more than three seconds after the player has completed his or her turn, the player is not eliminated and the fallen playing piece(s) 22 is/are returned to its/their original location. The last player remaining in the game is the winner. Players will employ strategy in selecting playing pieces 22 and base structures 20 based on their respective sizes and shapes and on which playing surfaces 30 are available for stacking.

In a second method of play using game device 10, the manner of play is similar to the first method except that players are not eliminated if playing pieces 22 fall during play. Instead, points are awarded depending on the size of playing piece 22 being placed on playing surface 30 and points are deducted for playing pieces 22 that a player causes to fall. For example, small or size-one playing pieces 22 receive one point, while large or size-six playing pieces 22 receive six points when stacked successfully. Similar points are deducted from the player's total if playing pieces 22 fall. In this version, if a player rolls the same result on two consecutive rolls of the die, the player receives double points if he or she is successful in placing the selected playing piece 22 on the selected playing surface 30. The winner is the player having the most points after an agreed upon number of rounds of play. This method of play is suitable for play in teams of two or more.

In a third method of play using game device 10, the manner of play is similar to the second method except that all players cooperate and add their points together. When the first playing piece 22 falls the game is over. The object of the game under this method is to achieve a point total that exceeds the point totals of previous attempts or to establish a maximum point total. This method of play is suitable for one or multiple players.

Other methods of play can be anticipated wherein players receive a predetermined amount of play money at the beginning of the game. A player places a selected amount of play money into a pot at the beginning of each turn and receives a payout from the pot of double the amount paid in if the number or colour of die 23 is the same on both rolls, or if the player successfully guesses the result of the first roll of die 23. If a player does cause one of playing pieces 22 to fall, the player is permitted to buy his or her way back into the game, if that player has sufficient money remaining. The cost of buying back into the game increases as the game progresses and players running out of money are eliminated. The last player remaining in the game is the winner and receives all the money in the pot.

It will be appreciated by those skilled in the art that only certain configurations of the present invention and methods of play have been illustrated herein by the applicant, but that other configurations, designs and methods, that fall within the scope of the present invention, as herein described by the applicant, are possible. It is therefore likely that the invention may be embodied in other specific forms without departing from the spirit or essential characteristics of the invention. The present embodiments are to be considered as illustrative and not restrictive, the scope of the invention being indicated by the appended claims rather than by the foregoing description, and all changes that come within the meaning and range of equivalency of the claims are therefore intended to be embraced therein.

I claim:

1. A game comprising:

multiple base structures, each of said base structures having at least one substantially planar playing surface thereon, at least one of said playing surfaces being non-horizontal; and multiple non-uniformly shaped playing pieces suitable for stacking on said playing surfaces in an unrestricted manner in accordance with rules for playing the game, said playing pieces varying in size according to a predetermined number of preselected sizes, said playing pieces being coloured, said playing pieces having the same said preselected size being the same colour, said differently sized playing pieces being differently coloured, the number of said base structures being equal to said predetermined number of said preselected sizes of said playing pieces, each of said base structures having a preselected colour, and each said preselected colour of said base structures corresponding to the colour of a selected one of said playing pieces.

2. The game of claim 1, further including a game board, for attachment of said base structures thereon.

3. The game of claim 2, wherein said base structures are removably securable to said game board.

4. The game of claim 3, wherein said base structures are attached to a game insert, said game insert being removably securable to said game board.

5. The game of claim 2, wherein said game board includes legs for supporting said game board in an upright, substantially horizontal game playing position.

6. The game of claim 5, wherein said legs are removably securable to said game board.

7. The game of claim 2, wherein said game board includes an upper surface for attachment of said base structures thereon and a storage compartment located below said upper surface.

8. The game of claim 1, wherein said playing surfaces are non-uniform in shape and surface area.

9. A game comprising:

a game board;

multiple base structures removably securable to said game board, each of said base structures having one or more substantially planar playing surface thereon, selected ones of said playing surfaces being non-horizontal, said playing surfaces being non-uniform in shape and surface area; and multiple non-uniformly shaped playing pieces suitable for stacking on said playing surfaces in an unrestricted manner in accordance with rules for playing the game, said playing pieces varying in size according to a predetermined number of preselected sizes, said playing pieces being coloured, said playing pieces having the same said preselected size being the same colour, said differently sized playing pieces being differently coloured, the number of said base structures being equal to said predetermined number of said preselected sizes of said playing pieces, each of said base structures having a preselected colour, and each said preselected colour of said base structures corresponding to the colour of a selected one of said playing pieces.

10. A game comprising:

multiple base structures, each of said base structures having at least one substantially planar playing surface thereon; and multiple non-uniformly shaped playing pieces suitable for stacking on said playing surfaces in an unrestricted manner in accordance with rules for playing the game, said playing pieces varying in size according to a predetermined number of preselected sizes, wherein the number of said base structures is equal to said predetermined number of said preselected sizes of said playing pieces, said playing pieces being coloured, said playing pieces having the same said preselected size being the same colour, said differently sized playing pieces being differently coloured, each of said base structures having a preselected colour, and each said preselected colour of said base structures corresponding to the colour of a selected one of said playing pieces.

11. The game of claim 10, wherein at least one of said playing surfaces is non-horizontal.

12. A method of game play comprising:

assembling multiple base structures on a surface, each of said base structures having at least one substantially planar playing surface thereon, at least one of said playing surfaces being non-horizontal;

providing multiple non-uniformly shaped playing pieces suitable for stacking on said playing surfaces in an unrestricted manner, said playing pieces varying in size according to a predetermined number of preselected sizes, said playing pieces being coloured, said playing pieces having the same said preselected size being the same colour, said differently sized playing pieces being differently coloured, the number of said base structures being equal to said predetermined number of said preselected sizes of said playing pieces, each of said base structures having a preselected colour, and each said preselected colour of said base structures corresponding to the colour of a selected one of said playing pieces;

selecting one of said playing pieces and one of said base structures; and placing said selected playing piece on one of said playing surfaces on said selected base structure.

13. The method of claim 12, wherein said playing surfaces are non-uniform in shape and surface area.

14. A method of game play comprising:

assembling multiple base structures on a surface, each of said base structures having at least one substantially planar playing surface thereon;

providing multiple non-uniformly shaped playing pieces suitable for stacking on said playing surfaces in an unrestricted manner, said playing pieces varying in size according to a predetermined number of preselected sizes;

selecting one of said playing pieces and one of said base structures; and placing said selected playing piece on one of said playing surfaces on said selected base structure, wherein the number of said base structures is equal to said predetermined number of said preselected sizes of said playing pieces, said playing pieces being coloured, said playing pieces having the same said preselected size being the same colour, said differently sized playing pieces being differently coloured, each of said base structures having a preselected colour, and each said preselected colour of said base structures corresponding to the colour of a selected one of said playing pieces.

15. The method of claim 14, wherein at least one of said playing surfaces is non-horizontal.

* * * * *